United States Patent [19]

Puig Planas

[11] 4,244,480

[45] Jan. 13, 1981

[54] CAP FOR SEALING CONTAINERS

[75] Inventor: Antonio Puig Planas, Barcelona, Spain

[73] Assignee: Teco Iberica, S.A., Barcelona, Spain

[21] Appl. No.: 59,958

[22] Filed: Jul. 23, 1979

[30] Foreign Application Priority Data

Jun. 7, 1979 [ES] Spain ..... 243.808

[51] Int. Cl.[3] ..... B65D 41/30

[52] U.S. Cl. ..... 215/320; 215/334; 215/341; 215/354

[58] Field of Search ..... 215/320, 329, 334, 341, 215/354, 361

[56] References Cited

U.S. PATENT DOCUMENTS

| | | | |
|---|---|---|---|
| 2,670,869 | 3/1954 | Martin | 215/354 |
| 2,689,665 | 9/1954 | Martin | 215/334 |
| 2,734,651 | 2/1956 | Lindstrom | 215/329 |
| 3,599,821 | 8/1971 | Eggert | 215/320 X |
| 3,685,678 | 8/1972 | Ritzenhoff | 215/334 |

*Primary Examiner*—Donald F. Norton
*Attorney, Agent, or Firm*—Staas and Halsey

[57] ABSTRACT

Cap for sealing containers comprising a hood member, a resilient sealing member adapted for press fit insertion in the container neck, an axial rod engaging internally with said sealing member and an annular portion fixedly attached to said hood member and adapted for retaining the sealing member.

1 Claim, 2 Drawing Figures

CAP FOR SEALING CONTAINERS

FIELD OF THE INVENTION

The present invention relates to a cap for sealing containers, of the type having a hood member for surrounding the side walls and top of the container neck and a resilient material sealing member adapted for press fit insertion in the interior of the neck and having a generally hollow cylindrical shape, closed at one end and having an annular flange at the other end.

The desirability of being able hermetically to seal containers for perfumes, essences, other volatile products and even products of other natures is well known.

To this end, there are known sealing systems comprising essentially, on the one hand, a rigid conventional cap formed by a base having a peripheral skirt portion extending therefrom, which combination covers the side and top portions of the container neck and, on the other hand, by a sealing member portion which is press fitted in the interior of the neck. Nevertheless, in these known closing systems, the conventional cap and the sealing member are separable. It is therefore frequent that after the container has been opened for the first time, on re-closing it, the user either forgets to replace the sealing member or inserts it incorrectly, whereby the container is imperfectly sealed.

Also known are the sealing systems in which the rigid portion of the cap for covering the side and top portions of the container neck also is provided with an internal axial extension adapted for press fit insertion in the interior of the neck. Nevertheless, in these systems, since the said extension is rigid, if the container is also rigid, as of glass, it is not possible to obtain a practical good fit between the axial extension and the interior of the neck.

SUMMARY OF THE INVENTION

With a view to overcoming these objections, a cap of the above type has been devised, which fundamentally comprises in combination an axial rod jutting out from the interior of the hood member, the free end of which is applied internally against the closed end of the sealing member and an annular portion, fixedly attached to the hood member, adapted to hold the sealing member by means of the annular flange thereof.

Preferably according to the invention, there is a clearance between the axial rod and the inner cylindrical surface of the sealing member.

In a further embodiment of the invention, the cap is provided with an inner body member fixedly attached to the said hood member, formed by a first body portion having its outer lateral configuration of the same dimensions as the inner side wall of the hood member, said first body portion being attached at the lower end thereof by a joining portion to a second body portion suitable for adaptation against the outer side wall of the neck, there being defined between the two a substantially tubular free space and said second member being crowned by an annular portion adapted to cover the edges of the neck orifice, leaving the aperture free, and adapted to retain the sealing member.

BRIEF DESCRIPTION OF THE DRAWINGS

To facilitate the understanding of the foregoing, reference is made hereinafter to the sheet of drawings accompanying the present Specification. Such drawings, in view of their explicative purpose, must be deemed to be free from any limitative nature with respect to the scope of the legal protection being sought. In the drawings.

DETAILED DESCRIPTION OF A PREFERRED EMBODIMENT

Figure 1:
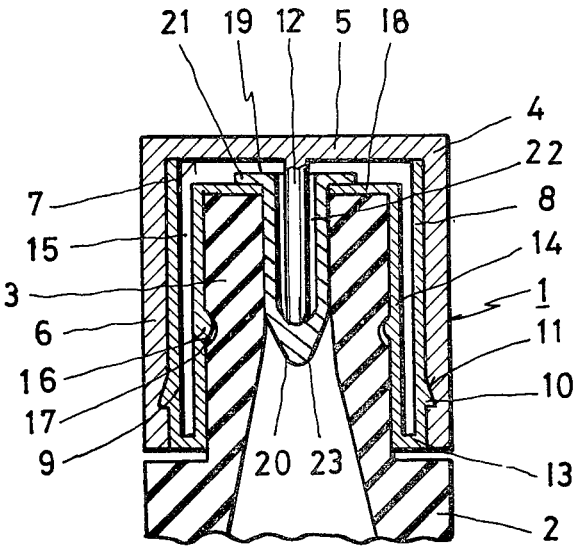
FIG. 1 is a vertical section of the cap of the invention fitted to a container.

In the Figures, there is shown the cap 1 of the invention fitted to the container 2, shown only in part in FIG. 1, and which is provided with a neck 3. Externally, the cap may adopt any shape and the same may be said of the container.

The cap 1 comprises a hood member 4 or external body which is the portion which may be given the functional or aesthetic form considered to be most appropriate. The said hood member 4 is formed with a center portion or base 5 which has extending from the periphery thereof a substantially cylindrical or prismatic skirt portion 6. Preferably, the inner surface 7 of the base or centre portion is flat. Fixedly attached to the hood member there is an inner body member 8 formed by a first body portion 9, the outer lateral configuration of which has the same dimensions as the inner side wall of the skirt portion 6 of the hood member 4. The hood member 4 and the inner body member 8 are bonded together in such a way that functionally they form an integral member and such bonding may be effected by a tooth 10 or the inner body member lodged in a notch 11 of the hood member or by adhesive bonding heat sealing or any other system.

A rod 12 extends axially from the inner surface 7 of the base 5 of the hood member 4, the purpose of which will be explained hereinafter.

The first body portion 9 of the inner body member 8 is attached by a joining portion 13 to a second body portion 14 which is suitable for adaptation to the outer side wall surface of the neck 3. Between the two portions of the inner body member 8 there is defined a substantially tubular free space 15. The presence of the joining portion 13 and of the space 15 provides for possible flexion of the second body portion 14. The inner surface of said second body portion is provided preferably with a rib 16 adapted for insertion in a groove 17 of the neck 3 for the purpose of helping to retain the cap on the container. The said rib and groove may be annular or helical. It is also possible to hold the cap on the neck with other conventional means, not shown.

The second body portion 14 is crowned with an annular flange portion 18 adapted for covering the edges of the neck orifice.

The cap also comprises the sealing member 19 made from resilient material and adapted for press fitting in the interior of the neck. This sealing member has a substantially hollow cylindrical shape, closed at one end 20, preferably with a rounded tip conical form. The sealing member 19 is provided at its other open end with a radially outwardly extending annular flange 21, adapted to bear directly or indirectly against the edges of the neck orifice.

Figure 2:
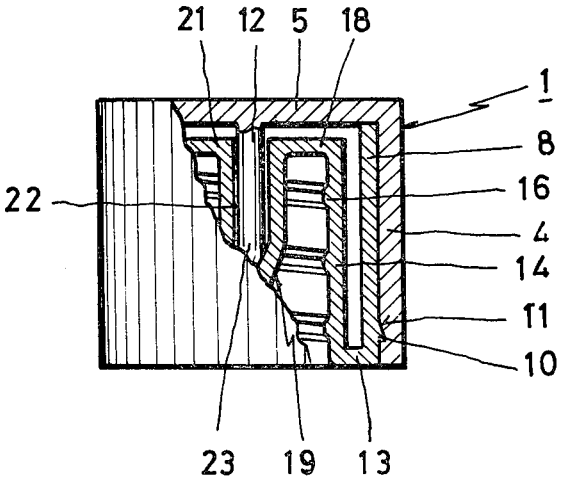
FIG. 2 is an elevation view of a second embodiment of the cap, partly in axial section, removed from the container.

Said sealing member is preferably an independent member, as seen in FIG. 1. Nevertheless, in an alternative embodiment of the invention, the inwardly extending flange 18 of the inner body member 8 may simultaneously form the outwardly extending annular flange 21 of the sealing member, whereby said inner body member and sealing member will form an integral body (FIG. 2).

The axial rod 12 is so inserted in the interior of the sealing member 19 that there is a free space or clearance 22 between the rod and the inner cylindrical surface of the sealing member 19, permitting resilient deformation of the sealing member on being inserted in the interior of the neck, for the purpose of providing a perfect fit between the member 19 and the inner wall of the neck. The free end 23 of the rod 12 is preferably rounded and bears against the closed end 20 of the sealing member.

In the light of the foregoing, it will be understood that the cap according to the invention provides a hermetic seal for the container, mainly by the resilient application of the sealing member in the interior of the neck, which application is provided by the action of the axial rod in said sealing member. The tightness of the seal is also improved by the application against the neck orifice.

What I claim is:

1. A cap for sealing containers, said cap having a hood member adapted for surrounding the side walls and top of the container neck and a resilient material sealing member adapted for press fit insertion in the interior of the neck and having a generally hollow cylindrical shape, closed at one end and having an annular flange at the other end, comprising in combination: an axial rod extending from the interior of the hood member, the free end of which is applied in the interior of the sealing member against the closed end thereof and an annular portion attached to the hood member and adapted for retaining the sealing member by means of the annular flange thereof, and having an inner body member attached to the hood member and formed by a first body portion having its outer lateral configuration of the same dimensions as the inner side wall of the hood member, said first body portion being attached at the lower end thereof by way of a joining portion to a second body portion suitable for adaptation to the outer side wall of the neck, there being defined between said body portions a substantially tubular free space and said second body portion being crowned by said annular portion adapted to cover the edges of the neck orifice, leaving the orifice free, and to retain the sealing member.

* * * * *